United States Patent [19]

Irgens

[11] 4,102,615

[45] Jul. 25, 1978

[54] INTERNALLY COOLED ROTARY COMBUSTION ENGINE

[76] Inventor: Finn T. Irgens, 2424 N. Harding Blvd., Wauwatosa, Wis. 53226

[21] Appl. No.: 732,024

[22] Filed: Oct. 13, 1976

[51] Int. Cl.[2] ..... F01C 21/06

[52] U.S. Cl. ..... 418/86; 418/94; 418/101

[58] Field of Search ..... 418/75, 79, 85, 86, 418/88, 91, 94, 101, 104, 142

[56] References Cited

U.S. PATENT DOCUMENTS

| | | | |
|---|---|---|---|
| 3,234,921 | 2/1966 | Laing et al. | 418/85 X |
| 3,302,623 | 2/1967 | Zimmermann | 418/101 X |
| 3,540,815 | 11/1970 | Belzner et al. | 418/142 X |
| 3,838,951 | 10/1974 | Furuya et al. | 418/104 X |
| 3,907,466 | 9/1975 | Canale | 418/75 |

*Primary Examiner*—Carlton R. Croyle
*Assistant Examiner*—Leonard E. Smith
*Attorney, Agent, or Firm*—Michael, Best & Friedrich

[57] ABSTRACT

Disclosed herein is a rotary internal combustion engine comprising a housing including walls defining a rotor cavity having axially spaced sides, a rotor shaft rotatably supported by the housing, extending through the rotor cavity, and including an eccentric, a rotor rotatably supported on the eccentric and within the rotor cavity, which rotor includes equi-angularly spaced apexes which, together with the rotor cavity, define working chambers rotatable within the rotor cavity, which rotor also includes side seals engaging the rotor cavity sides to restrain leakage of pressure from the working chambers, meshed gears on the rotor and on the housing for causing rotation of the rotor on the eccentric and rotation of the rotor shaft relative to the housing, and a gas recirculation system extending, at least in part, in the housing and including means defining a closed gas recirculation path including a first path portion in the rotor, a second path portion in the rotor shaft, a third path portion located to receive gas leaking past the rotor side seals, and a fan driven by the engine for pumping gas through the path.

14 Claims, 4 Drawing Figures

INTERNALLY COOLED ROTARY COMBUSTION ENGINE

BACKGROUND OF THE INVENTION

The invention relates generally to rotary internal combustion engines. More particularly, the invention relates to arrangements for cooling the internal components of a rotary internal combustion engine and to arrangements for increasing the effective horse power output of such engines. In addition, the invention relates to arrangements for diminishing the loss of pressure gas past the rotor side seals.

In the past, the incoming fuel-air charge has sometimes been used to cool the rotor and rotor shaft or crankshaft of a rotary internal combustion engine. However, the use of the incoming fuel-air charge for cooling generally involves a sacrifice in the volumetric efficiency of the engine.

SUMMARY OF THE INVENTION

The invention provides a rotary internal combustion engine comprising a housing including wall means defining a rotor cavity having axially spaced sides, a rotor shaft rotatably supported by the housing, extending through the rotor cavity, and including an eccentric, a rotor rotatably supported on the eccentric and within the rotor cavity, which rotor includes equi-angularly spaced apexes which, together with the rotor cavity, define working chambers rotatable within the rotor cavity, side seal means engaging the rotor cavity sides to restrain leakage of pressure from the working chambers, meshed gear means on the rotor and on the housing for causing rotation of the rotor on the eccentric and rotation of the rotor shaft relative to the housing, and a gas recirculation system extending, at least in part, in the housing and including means defining a closed gas recirculation path including a first path portion in the rotor, a second path portion in the rotor shaft, a third path portion located to receive gas leaking past the rotor side seals, and fans means driven by the engine for pumping gas through the path.

In one embodiment in accordance with the invention, the housing also includes wall means defining an end cavity axially adjacent to the one of the rotor cavity sides, wall means defining a fan cavity axially adjacent to the other of the rotor cavity sides, and a pressure cavity communicating with the fan cavity. In addition, the rotor shaft extends through the end cavity and the fan cavity and further includes wall means extending radially into the fan cavity to define a fan, means defining a transfer duct communicating, at one end, with the end cavity, and communicating, at the other end, with the fan cavity, and aperture means defining a transfer port communicable with the pressure cavity. Still further in addition, the rotor includes port means located radially inwardly of the side seal means adjacent at least one of the apexes, communicating with the end chamber, and communicable with the transfer port whereby to permit gas flow from the pressure cavity to the end cavity. The end cavity, the transfer duct, the fan cavity, the pressure cavity, the transfer port, and the port means all comprise part of the gas recirculation system.

In one embodiment in accordance with the invention, the recirculation path is wholly contained within the housing.

In one embodiment in accordance with the invention, the recirculation path is closed, at least in part, by sealing means extending between the housing and the rotor shaft for preventing escape of gas from the gas recirculation system.

In one embodiment in accordance with the invention, the engine further includes means for cooling the gas recirculation system.

In one embodiment in accordance with the invention, the cooling means comprises means on the housing defining a water jacket extending adjacent to at least a part of the gas recirculation system.

In one embodiment in accordance with the invention the cooling means comprises an air cooled heat exchanger.

In one embodiment in accordance with the invention, the heat exchanger includes ducts communicating between the fan cavity and the pressure cavity and defining therebetween air passages, and fan means on the engine for delivering air through the air passages.

One of the principal features of the invention is the provision of a rotary internal combustion engine including means for reducing leakage of pressurized gas from the working chambers past the rotor side walls.

Another of the principal features of the invention is the provision of a rotary internal combustion engine including a gas recirculation system for cooling of the internal components of the engine.

Another of the principal features of the invention is the provision of a rotary internal combustion engine including a relatively economical arrangement for gas cooling of internal engine components without lowering volumetric efficiency.

Another of the principal features of the invention is the provision of a rotary internal combustion engine wherein the gas leaking past the rotor side seals is recirculated within a closed system at least partially within the housing of the engine so as to reduce gas loss past the side walls and to provide a pressurized gas flow having an increased capability for heat removal from the internal components of the engine.

Another of the principal features of the invention is the provision of a rotary internal combustion engine as referred to in the preceding paragraph including gas seals between te rotor shaft and the housing to prevent or minimize loss of gas from the interior of such an engine.

Other features and advantages of the embodiments of the invention will become known by reference to the following general description, appended claims and drawings.

THE DRAWINGS

Figure 2:
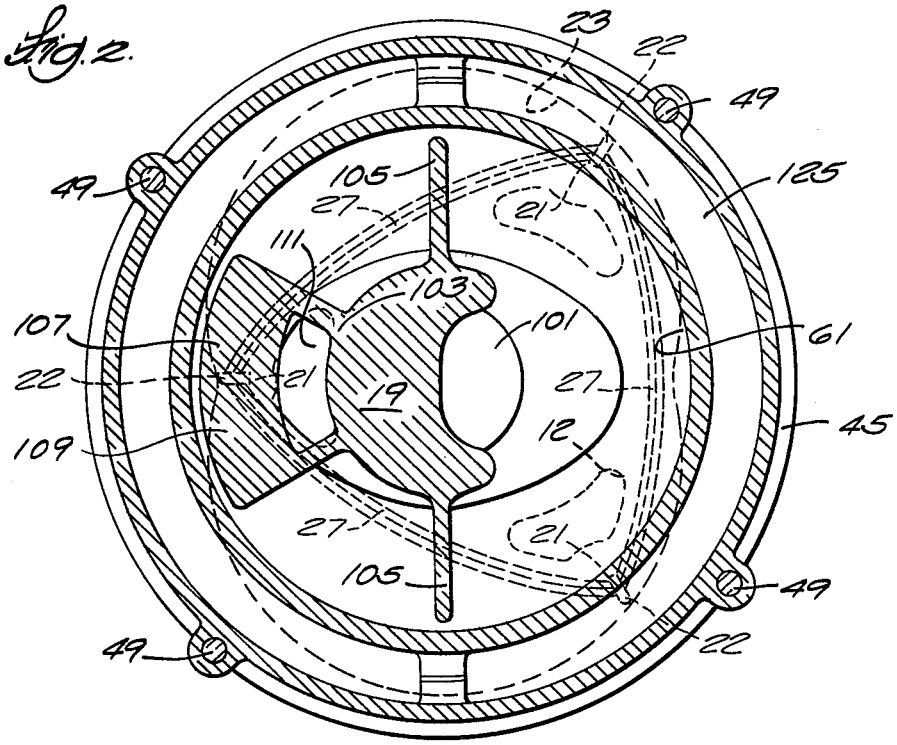
FIG. 2 is a sectional view with parts omitted showing the construction of the rotor shaft.

Before explaining the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 1:
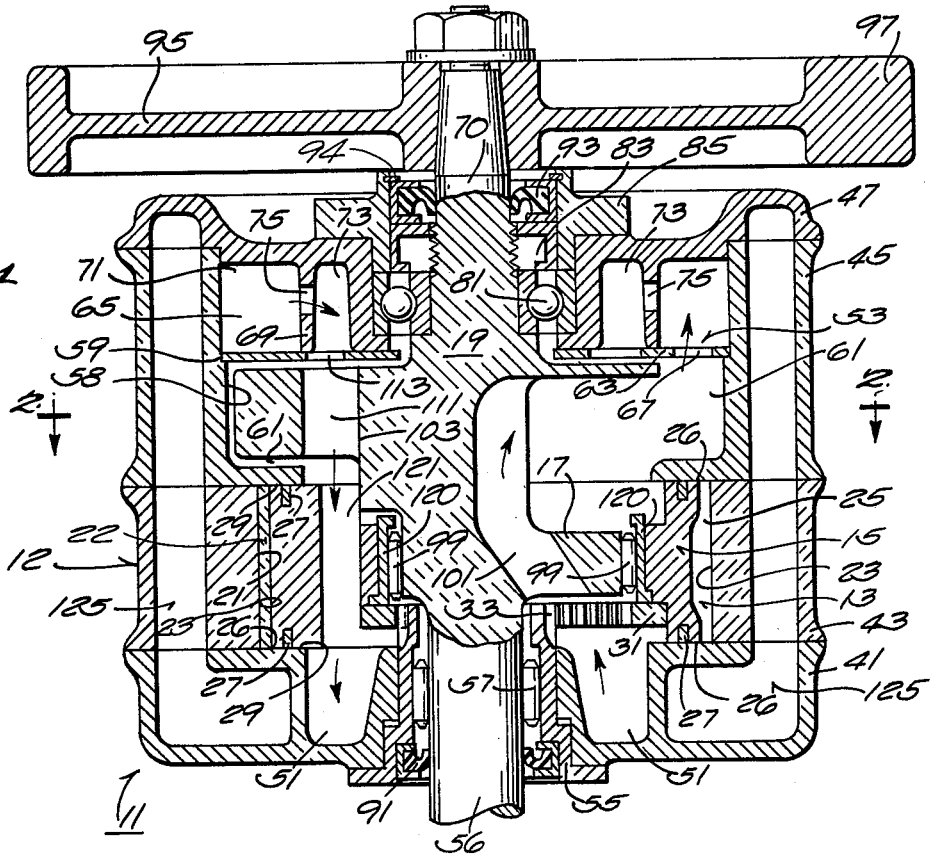
FIG. 1 is a sectional view of a rotary internal combustion engine embodying various of the features of the invention.

Shown in FIGS. 1 and 2 of the drawings is a rotary internal combustion engine 11 which is of the general type including a housing 12 including wall means defining a two lobed, rotor cavity 13 and a rotor 15 which is rotatably supported on an eccentric portion 17 of a crankshaft or rotor shaft 19 rotatably supported by the housing 12. In general, the rotor 15 is triangular in shape including three equi-angularly spaced apexes 21 including seals 22 which wipe or engage the peripheral end wall 23 of the rotor cavity 13 to form three working chambers 25 which rotate in response to rotor rotation. Any suitable means can be employed for supplying a combustible mixture to the working chambers 25, for igniting the combustible mixture in the working chambers 25, and for exhausting burnt products of combustion from the working chambers 25.

Extending along the side walls 26 of the rotor 15 between the apexes 21 are side seals 27 which engage the side walls 29 of the rotor cavity 13 to minimize leakage of gas under high pressure from the working chambers 25 between the rotor side walls 26 and the cavity side walls 29. In addition, the rotor 15 has fixed thereto an internal ring gear 31 which meshes with an external ring gear 33 fixed on the housing 12 so as to cause rotation of the rotor 15 and the rotor shaft 19 relative to the housing assembly 12. In this regard, the rotor 15 rotates 120° for every 360° of rotation of the rotor shaft 19.

Although the housing 12 which can be constructed in various ways, in the illustrated construction shown in FIGS. 1 and 2, the housing 12 comprises an assembly of four adjacently located and fixedly connected housing members 41, 43, 45 and 47 which are preferably of cast aluminum. Any suitable arrangement, such as a series of through bolts 49 can be employed to fixedly assemble or connect the housing members 41, 43, 45 and 47.

The housing member 43 includes wall means defining the trochoid shaped, peripheral end wall 23 of the rotor cavity 13.

The housing member 41 constitutes an end housing member which is located in axially adjacent abutting relation to one side of the housing member 43 and which includes wall means extending radially inwardly beyond the side seals 27 of the rotor 15 to define one of the rotor cavity side walls 29 which, in part, define the working chambers 25. In addition, the end housing member 41 includes wall means defining an end chamber or cavity 51 which constitutes a part of a gas recirculation system 53 and which communicates with the rotor cavity 13 radially inwardly of the innermost area of engagement between the rotor side seals 27 and the rotor cavity side walls 29. The chamber or cavity 51 is preferably elliptical with its major axis extending generally coincidental with the major axis of the trochoid shaped cavity 13 and with maximum dimensions which terminate radially inwardly of the innermost area of engagement between the rotor side seals 27 and the rotor cavity side walls 29.

The end housing member 41 has fixed thereto a sleeve 55 of hardened steel which includes the external stationary ring gear 33 and which supports bearing means for rotatably supporting one end 56 of the rotor shaft 19. In the illustrated construction, the bearing means comprises a roller bearing 57.

The housing member 45 is located in axially adjacent abutting relation to the other side of the housing member 43 and includes wall means extending radially inwardly beyond the side seals 27 of the rotor 15 to define the other one of the side walls 29 of the rotor cavity 13. In addition, the housing member 45 includes a counterbored annular recess 58 which is coaxial with the rotary axis of the rotor shaft 19 and which includes an annular shoulder 59. The recess 58 defines, in part, a fan chamber or cavity 61 which extends from the shoulder 59 to adjacent to the rotor cavity 13 and which communicates therewith inwardly of the innermost area of engagement between the rotor side seals 27 and the rotor cavity side walls 29. The fan cavity 61 is completed by a partition 63 which is located against the shoulder 59 and which, in part, defines an axially adjacent pressure cavity or chamber 65 which communicates with the fan chamber 61 through an axially open circumferential series of openings 67 in the partition 63.

The housing member 47 constiutes an end housing member which is located in axially adjacent abutting relation to the housing member 45, which closes the pressure chamber 65 and which includes an axially inwardly extending rib or partition 69 which divides the pressure cavity or chamber 65 into an outer annular receiving part 71 and an annular inner discharging part 73. The annular parts 71 and 73 communicate with each other through a circumferential series of radial ports 75 in the axially extending circular rib 69.

The end housing member 47 also includes wall means supporting bearing means rotatably supporting the other end 70 of the rotor shaft 19. While various bearing means can be employed, in the illustrated construction, such bearing means comprises a ball bearing 81 retained in place, in part, by a nut 83 threaded on the rotor shaft 19 and by a sleeve 85 which is suitably fixed to the end housing member 47.

Means are provided at each of the ends 56 and 70 of the rotor shaft and preferably outwardly of the bearings 57 and 81 for providing gas seals 91 and 93 between the rotor shaft 19 and the housing assembly 12. While other constructions are possible, in the illustrated construction, the seals 91 and 93 are fabricated to provide increasing sealing action in response to the presence, axially inwardly of the seals 91 and 93, of increasing gas pressure, and can be respectively retained in place by snap rings 94 carried by the sleeves 55 and 85. (Only one of the snap rings is shown, i.e., the snap ring 95 in the sleeve 55 shown in FIG. 1.)

Mounted on the end 70 of the rotor shaft 19 is a flywheel 95 including a counterweight 97.

The rotor shaft 19 is preferably of cast steel construction and includes the aforementioned eccentric portion 17 which carries suitable bearing means, such as the roller bearings 99 which support the rotor 15. In addition, the rotor shaft 19 is provided with a transfer duct 101 which, at one end, communicates with the end chamber or cavity 51 and which, at the other end, communicates with the fan chamber or cavity 61, thus permitting continuous gas flow from the end chamber or cavity 51 to the fan chamber or cavity 61 through the rotor shaft 19 inwardly of the rotor 15.

The rotor shaft 19 also includes a part 103 which extends into the fan cavity and provides a centrifugal fan. While various fan constructions can be employed, in the illustrated construction, the fan part 103 includes two diametrically opposed vanes 105 which sweep through the fan cavity 61. In addition, the fan part 103 includes an apertured, radially extending portion 107 which provides a second counterweight 109, which acts as another fan vane, and which includes an aperture or port 111 adapted to periodically communicate with the inner part 73 of the pressure chamber or cavity 65 through a transfer port 113 in the partition 63. More specifically, the transfer port 113 periodically communicates through the port 111 with the inner part 73 of the pressure chamber or cavity 65 once every 360° of rotor shaft rotation.

The counterweight 109 provided in the fan part 103 of the rotor shaft 19, together with the counterweight 97 in the flywheel 95 are arranged to effectively rotationally counter-balance the eccentric mass of the rotor shaft 19 and rotor 15.

The rotor 15 is preferably of cast aluminum construction and includes a steel liner 120 which cooperates with the roller bearings 99 on the eccentric portion 17 of the rotor shaft 19. In addition, the rotor 15 includes adjacent at least one of the apexes 21 and preferably adjacent to each of the apexes 21, and inwardly of the side seals 27, a transfer port 121 which, at one end, communicates with the end cavity or chamber 51 and which, at its other end, registers periodically with the transfer port 111 in the fan part 103 of the rotor shaft 19 so as to establish communication between the rotor shaft transfer port 111 and the rotor transfer port 121 and thereby establish communication between the inner part 73 of the pressure cavity or chamber 65 and the end cavity or chamber 51 thus permitting axial flow of the gas pressurized, in part, by the centrifugal fan, from the pressure cavity or chamber 65 to the end cavity or chamber 51.

Rotation of the rotor shaft 19, coupled with communication through the rotor shaft transfer duct 101 from the end cavity 51 to the fan cavity 61, causes suction of the gas in the end cavity or chamber 51 and delivery thereof through the rotor shaft transfer duct 101 to the fan cavity or chamber 61 by the centrifugal fan which also serves to deliver the gas to the outer part 91 of the pressure cavity 65 and then through the radial ports 75 to the inner part 73 of the pressure cavity 65 to complete the gas recirculation path or system 53 for pressurized gases which have escaped past the side seals 27 form the working chambers 25 and which are sealed within the housing assembly 12 by the rotor shaft seals 91 and 93.

The sealed condition of the gas recirculation path or system 53 within the housing assembly 12 coupled with gas leakage from the working chambers 25, causes increasing pressure within the recirculation system, until a balance is achieved with the working chambers 25, which balance substantially restricts further loss of pressurized gas from the working chambers 25.

In addition, the recirculation of the gases sealed within the housing assembly 12 exteriorly of the working chambers 25, and the increased heat carrying capacity resulting from the increased pressure of these gases in the recirculation system 53 can advantageously be utilized to cool the rotor 15 and other interior parts of components of the engine 11.

Accordingly, the engine 11 also includes means for removing heat from the recirculation gases. While various arrangements, including both air cooling and water cooling can be employed, in the construction shown in FIGS. 1 and 2, there is formed in the housing members 41, 43, 45 and 47 a water jacket 125 which extends axially of the housing assembly 12 in adjacent relation to the rotor cavity 13, to the fan cavity 61, to the outer part 71 of the pressure cavity 65, and to the end cavity or chamber 51 to afford heat removal from the pressurized gases flowing through the recirculation system 53. Any suitable means (not shown) can be provided for supplying cooling water to, and draining cooling water from, the water jacket 125.

Figure 4:
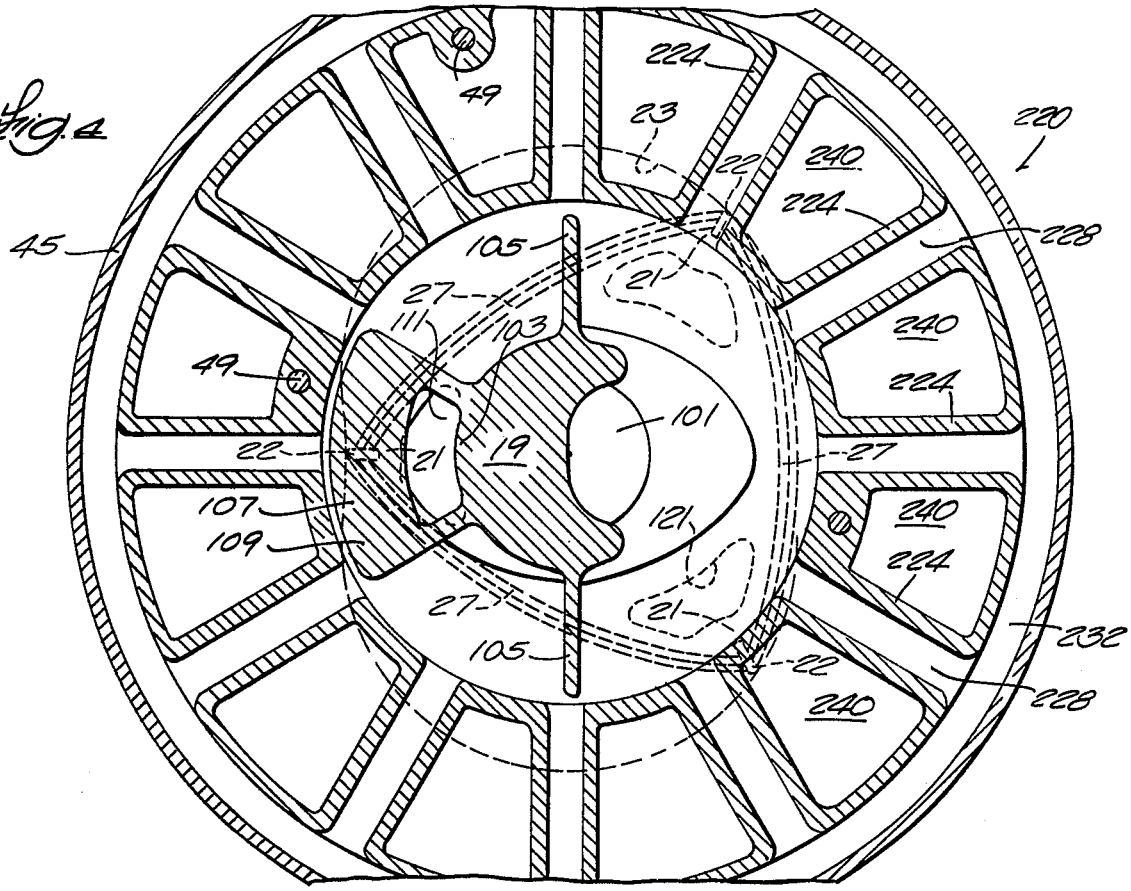
FIG. 4 is a view showing the construction of the crankshaft and associated heat exchanging system.
Figure 3:
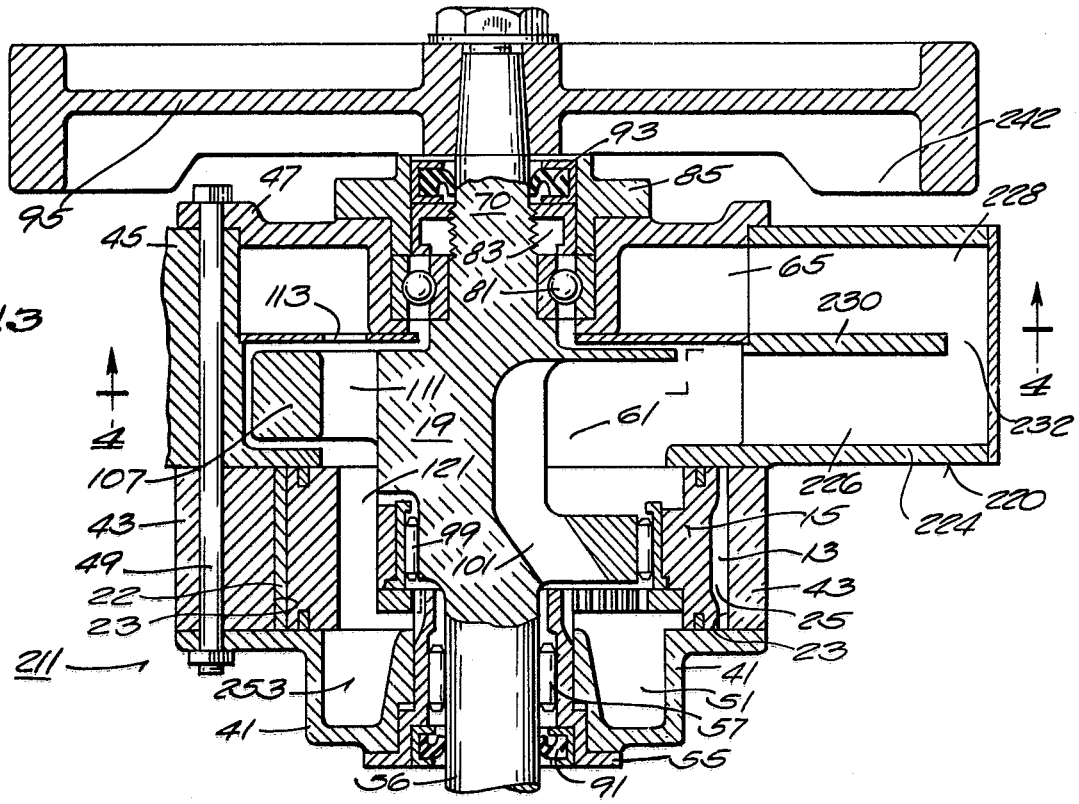
FIG. 3 is a view similar to FIG. 1 illustrating another embodiment of a rotary internal combustion engine in accordance with the invention.

Shown in FIGS. 3 and 4 is another embodiment of a rotary internal combustion engine 211 which is substantially similar to the engine 11 shown in FIGS. 1 and 2 except that the engine 211, and particularly the gas recirculation system 253, is air cooled as compared to being water cooled. As the construction of the engine 211 is basically the same as the engine 11, except as will be explained, the same reference numerals used in FIGS. 1 and 2 to identify the components of the engine 11 are used in FIGS. 3 and 4 to identify the comparable components of the engine 211.

As noted above, the engine 211 differs from the engine 11 in that all or part of the water jacket 125 is omitted and in that the engine 211 includes an air cooled heat exchanger 220 communicating between the fan cavity 61 and the pressure cavity 65. More specifically, in the engine 211 shown in FIGS. 3 and 4, the partition 63 does not include the openings 67 permitting direct communication between the fan cavity 61 and th pressure cavity 63 and the circumferential rib 69 provided on the end housing member 47 in the engine 11 is omitted. Instead, the housing member 45 is provided about at least a portion of its arcuate periphery with wall means which cooperate to define a series of radially outwardly extending and arcuately spaced spokes 224, each including a first duct 226 communicating at its radially inner end with the fan cavity 61 and a second duct 228 which is separated from the first duct by a partition 230 and which communicates at its radially inner end with the pressure cavity 65. At their outer ends, the first and second ducts 226 and 228 in each spoke 224 communicate with each other and with an arcuate duct 232 which interconnects all of the ducts 226 and 228 and which permits gas flowing outwardly from the fan cavity 61 through any of the first ducts 226 to flow inwardly to the pressure cavity 65 through any of the second ducts 228. Air passages 240 are provided between the spokes and between the main part of the housing assembly 12 and the arcuate duct 232 which is located in radially spaced relation from the main part of the housing assembly 12. Cooling air is delivered through the passages 240 to remove heat from the walls of the ducts 226, 228 and 232 and thereby from the gases flowing therein by a fan 242 which is formed as a part of the flywheel 95.

Thus, in the engine 211 shown in FIGS. 3 and 4, the fan part 103 of the rotor shaft 19 discharges the gas into the first ducts 226 wherein the gas initially flows outwardly and then returns through one or more of the second ducts 228 to the pressure chamber or cavity 65 for recirculation as already explained in connection with the engine 11 shown in FIGS. 1 and 2. While passing through the duct system of the heat exchanger 220, the pressurized gases give up heat to the duct walls which in turn give up heat to the air which is forced through the intervening air passages 240 by the fan 242. Thus, heat is removed from the pressurized gases which thereupon serve to cool the interior components of the engine 211 as well as to prevent or to minimize loss of pressurized gas across the side seals 27. As a consequence, increased horse power is obtained while at the same time cooling of the interior engine components is obtained without adversely effecting the volumetric efficiency of the engine.

The invention is applicable to rotary combustion engines with a rotor cavity having more than two lobes and with a rotor having more than three apexes.

Various of the features of the invention are set forth in the following claims.

What is claimed is:

1. A rotary internal combustion engine comprising a housing including wall means including spaced sides defining a rotor cavity, a rotor shaft rotatably supported by said housing, extending through said rotor cavity, and including an eccentric, a rotor rotatably supported on said eccentric and within said rotor cavity, said rotor including equi-angularly spaced apexes which, together with said rotor cavity, define working chambers rotatable within said rotor cavity, said rotor also including side seal means engaging said rotor cavity sides to restrain leakage of pressure from said working chambers, meshed gear means on said rotor and on said housing for causing rotation of said rotor on said eccentric and rotation of said rotor shaft relative to said housing, and a gas recirculation system extending, at least in part, in said housing and including means defining a closed gas recirculation path including, a first path portion in said rotor through which gas flows in one direction axially of said rotor, a second path portion in said rotor shaft through which gas flows in the direction opposite said one direction and, a third path portion located interiorly of said housing in series communication with and between said first and second path portions and in position for receiving gas leaking past said rotor side seals, and fan means driven by said engine for pumping gas through said recirculation path.

2. A rotary internal combustion engine in accordance with claim 1 wherein said path is wholly contained within said housing.

3. A rotary internal combustion engine in accordance with claim 1 wherein said path is closed, at least in part, by sealing means extending between said housing and said rotor shaft for preventing escape of gas from said gas recirculation system.

4. A rotary internal combustion engine in accordance with claim 1 and further including means for cooling said gas recirculation system.

5. A rotary internal combustion engine in accordance with claim 4 wherein said cooling means comprises means on said housing defining a water jacket extending adjacent to a part of said gas recirculation system.

6. A rotary internal combustion engine in accordance with claim 4 wherein said cooling means comprises an air cooled heat exchanger.

7. A rotary internal combustion engine in accordance with claim 6 wherein said heat exchanger includes ducts which form a part of said gas recirculation system and which define therebetween air passages, and fan means on said engine for delivering air through said air passages.

8. A rotary internal combustion engine comprising a housing including wall means defining a rotor cavity having axially spaced sides, wall means defining an end cavity axially adjacent to the one of said rotor cavity sides, wall means defining a fan cavity axially adjacent to the other of said rotor cavity sides, and a pressure cavity communicating with said fan cavity, a rotor shaft rotatably supported by said housing and extending through said end cavity, said rotor cavity and said fan cavity, said rotor shaft including an eccentric extending in said rotor cavity, said rotor shaft also including wall means extending radially into said fan cavity to define a fan, said rotor shaft also including means defining therein a transfer duct communicating, at one end, with said end cavity and communicating, at the other end, with said fan cavity, and said rotor shaft also including aperture means defining a transfer port communicable with said pressure cavity, and a rotor rotatably supported on said eccentric and within said rotor cavity, said rotor including equi-angularly spaced apexes which, together with said rotor cavity, define working chambers rotatable within said rotor cavity, said rotor also including side seal means engaging said rotor cavity sides to restrain leakage of pressure from said working chambers, and port means located radially inwardly of said side seal means adjacent at least one of said apexes, communicating with said end chamber, and communicable with said transfer port in said rotor shaft whereby to permit gas flow from said pressure cavity to said end cavity, said end cavity, said transfer duct, said fan cavity, said pressure cavity, said transfer port, and said port means comprising a gas recirculation system, meshed gear means on said rotor and on said housing for causing rotation of said rotor on said eccentric and rotation of said rotor shaft relative to said housing, and sealing means extending between said housing and said rotor shaft for preventing escape of pressurized gas from said gas recirculation system.

9. A rotary internal combustion engine in accordance with claim 8 wherein said pressure cavity includes a radially outer part communicating with said fan cavity and a radially inner part communicating with said radial outer part and communicable with said transfer port.

10. A rotary internal combustion engine in accordance with claim 8 and further including means for cooling said gas recirculation system 11. A rotary internal combustion engine in accordance with claim 10 wherein said cooling means comprises means on said housing defining a water jacket extending adjacent to a part of said gas recirculation system.

12. A rotary internal combustion engine in accordance with claim 10 wherein said water jacket extends adjacent to said end cavity, said fan cavity, and said pressure cavity.

13. A rotary internal combustion engine in accordance with claim 10 wherein said cooling means comprises an air cooled heat exchanger.

14. A rotary internal combustion engine in accordance with claim 13 wherein said heat exchanger includes ducts communicating between said fan cavity and said pressure cavity and defining therebetween air passages, and fan means on said engine for delivering air through said air passages.

* * * * *